US005945952A

United States Patent [19]

Davidson

[11] Patent Number: 5,945,952

[45] Date of Patent: Aug. 31, 1999

[54] ANTENNA SLEEVE HAVING MEANS FOR BLOCKING A ROD ANTENNA FROM SLIDING OFF THE HOUSING

[75] Inventor: Brian James Davidson, Surrey, United Kingdom

[73] Assignee: Nokia Mobile Phones Limited, Salo, Finland

[21] Appl. No.: 08/761,397

[22] Filed: Dec. 6, 1996

[30] Foreign Application Priority Data

Dec. 7, 1995 [GB] United Kingdom ..... 9525017

[51] Int. Cl.[6] ..... H01Q 1/24; H01Q 1/10

[52] U.S. Cl. ..... 343/702; 343/900; 343/901; 343/906; 403/326; 403/329

[58] Field of Search ..... 343/702, 900, 343/901, 906, 874, 875, 883; 439/9, 16; 403/326, 329, 104, 223, 328, 372, 377; H01Q 1/10, 1/24

[56] References Cited

U.S. PATENT DOCUMENTS

| | | | |
|---|---|---|---|
| 4,760,401 | 7/1988 | Imzeki | 343/702 |
| 4,998,078 | 3/1991 | Hulkko | 333/109 |
| 5,079,558 | 1/1992 | Koike | 343/702 |
| 5,204,687 | 4/1993 | Elliott et al. | 343/702 |
| 5,341,149 | 8/1994 | Valimaa et al. | 343/895 |
| 5,343,213 | 8/1994 | Kottke et al. | 343/702 |
| 5,426,440 | 6/1995 | Shimada et al. | 343/702 |
| 5,438,339 | 8/1995 | Itoh et al. | 343/702 |
| 5,561,439 | 10/1996 | Moilanen | 343/846 |
| 5,856,806 | 1/1999 | Koleda | 343/702 |

FOREIGN PATENT DOCUMENTS

| | | | |
|---|---|---|---|
| 1.127.511 | 8/1956 | France | 343/713 |
| 2 287 130 | 9/1995 | United Kingdom . | |

*Primary Examiner*—Donald Hajec
*Assistant Examiner*—Daniel St. Cyr
*Attorney, Agent, or Firm*—Perman & Green, LLP

[57] ABSTRACT

A radio device comprising a housing having an opening and a retaining surface, an antenna support sleeve inserted in the opening and a rod antenna mounted for sliding movement in the antenna support sleeve between extended and retracted positions, the antenna including a stop surface the sleeve including a first resilient, inwardly-directed member which abuts the stop surface when the antenna is in its fully extended position to block sliding removal of the antenna from the sleeve, the first member being outwardly displaceable using a tool to allow the stop surface to be slid past the first member and thereby enable sliding removal of the antenna from the sleeve and a second resilient member which engages the retaining surface to prevent removal of the sleeve from the housing.

8 Claims, 8 Drawing Sheets

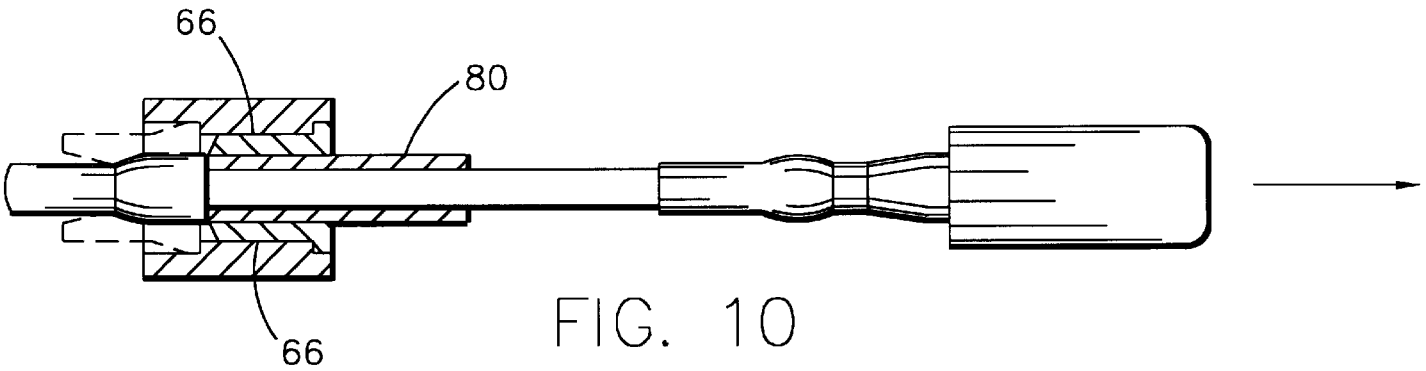
FIG. 10
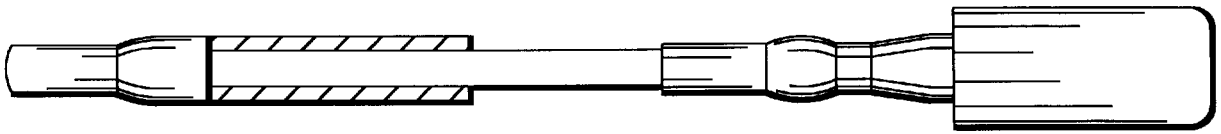
FIG. 11
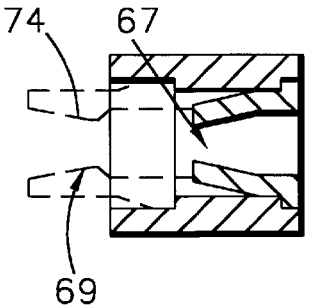

ANTENNA SLEEVE HAVING MEANS FOR BLOCKING A ROD ANTENNA FROM SLIDING OFF THE HOUSING

FIELD OF THE INVENTION

The present invention relates generally to radio devices.

BACKGROUND OF THE INVENTION

In such devices, it is known to equip a housing of the device with a rod antenna which can be retracted or extended through an opening in the housing.

Damage to the rod antenna such as snapping, bending or fracture can occur. It is, therefore, a requirement for the radio device that the damaged rod antenna be readily replaceable.

In one aspect, the present invention may provide an antenna support sleeve for slidably mounting therein a rod antenna, comprising means for push-fit mounting the sleeve to a radio housing and a resiliently inwardly-directed first member to block sliding removal of the antenna, the first member being outwardly displaceable to permit sliding removal of the antenna from the sleeve.

The sleeve comprises first and second ends and, preferably, the member can be displaced by a tool inserted from an end of the sleeve. Most preferably, the member can be outwardly displaced by a tool emanating from the end of the sleeve from which the road antenna is extended for operation. The tool may comprise an elongate bushing having an arcuate cross-section which is adapted to slide down the rod antenna.

Preferably, the push-fit mounting means comprises a second inwardly-displaceable resilient member including means to lockingly engage the housing.

Specifically, the engaging means may comprise a barb adapted to engage a shoulder in the housing.

Preferably, the first and second members are independently displaceable, whereby one member can be displaced without substantially causing displacement of the other. In this way, the rod antenna can be removed from the housing without removing the sleeve.

In another aspect, the present invention may provide a radio device comprising a housing having an opening and a retaining surface, an antenna support sleeve inserted in the opening and a rod antenna mounted for sliding movement in the antenna support sleeve between extended and retracted positions, the antenna including a stop surface, the sleeve including a first resilient, inwardly-directed member which abuts the stop surface when the antenna is in its fully extended position to block sliding removal of the antenna from the sleeve, the first member being outwardly displaceable using a tool to allow the stop surface to be slid past the first member and thereby enable sliding removal of the antenna from the sleeve and a second resilient member which engages the retaining surface to prevent removal of the sleeve from the housing.

Preferably, the first finger and/or second finger bear against the rod antenna during sliding to afford the user a feeling of resistance when the antenna is extended or retracted.

Preferably, the rod antenna includes contact elements at opposite end portions thereof which co-operate with the first and second fingers to positively hold the rod antenna in given predetermined extended and retracted positions.

The first and second members may be fingers. Preferably, the antenna support sleeves are one-piece constructions made out of metal or plastic.

BRIEF DESCRIPTION OF THE DRAWINGS

Exemplary embodiments of the invention are herein described with reference to the accompanying drawings, in which:

FIGS. 9–11 shows the removal of the rod antenna from the sleeve; and

DETAILED DESCRIPTION OF A PREFERRED EMBODIMENT

Figure 1:
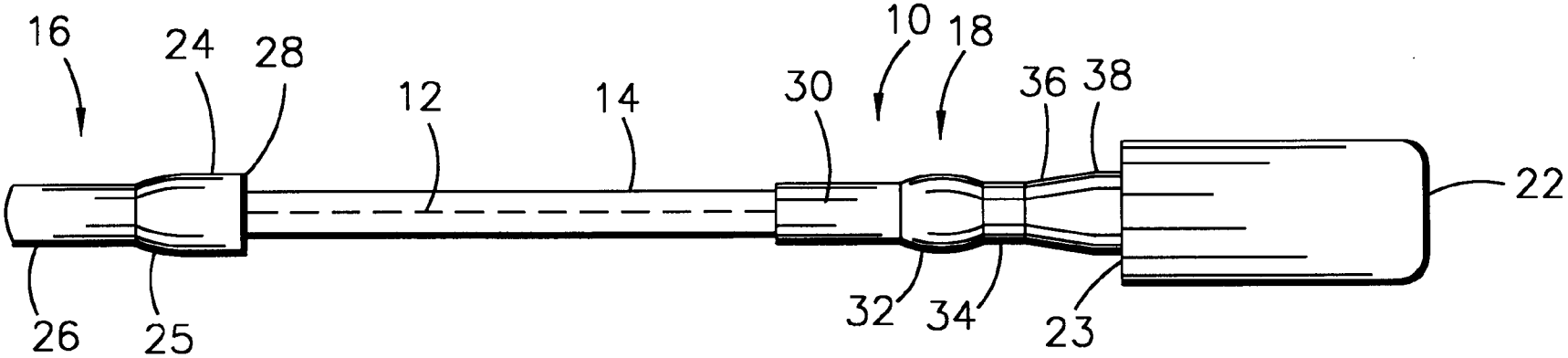
FIG. 1 shows a view of a rod antenna.

Referring to FIG. 1, a rod antenna for signal transmission and reception in a radio telephone is generally designated 10. It comprises an elongate radiating element 12 (shown in dashed lines) surrounded by an insulating sleeve or covering 14. The rod antenna 10 further comprises first and second electrically-conductive contact elements 16,18 conductively coupled to respective first and second ends of the elongate radiating element 12. The second contact element 18 is conductively coupled to a helical radiating element 20 which is housed in an insulating cap 22 of cylindrical shape. The bottom surface of the insulating cap is designated 23.

The first contact element 16 is a sleeve of circular but non-uniform cross-section along is length, which is closed at one and receives in the other open end the first end of the elongate radiating element 12. Starting from the open end of the sleeve and moving longitudinally along the sleeve towards the closed end, the sleeve comprises a cylindrical portion 24 which includes an end surface 28 which faces the second end of the elongate radiating element 12; a frusto-conical portion 25 the exterior diameter of which decreases from that of the portion 24 to a lesser exterior diameter along its length; and a cylindrical portion 26 having a diameter equal to the lesser exterior diameter of the portion 25. The second contact element 18 is also a sleeve of circular but non-uniform cross-section along its length which is closed at one end and receives in the other end the second end of the elongate radiating element 12. Starting from the open end and moving longitudinally along the sleeve towards the closed end, the sleeve comprises a cylindrical portion 30; a bowed portion 32 having an exterior diameter which varies from an exterior diameter equal to that of the portion 30 gently increases to a maximum diameter and gently decreases to an exterior diameter equal to that of the portion 30 along its length; a cylindrical portion 34 having an exterior diameter equal to that of the portion 30; a frusto-conical portion 36 having a exterior diameter which increases from that of the portion 30 to a greater diameter equal to the maximum exterior diameter of the bowed portion 32 along its length; and a cylindrical portion 38 having a diameter equal to the greater exterior diameter of the frusto-conical portion 36.

The exterior diameter of the portion 26 in the first contact element 16 is equal to the exterior diameter of the portion 30 of the second contact element 18.

Figure 2:
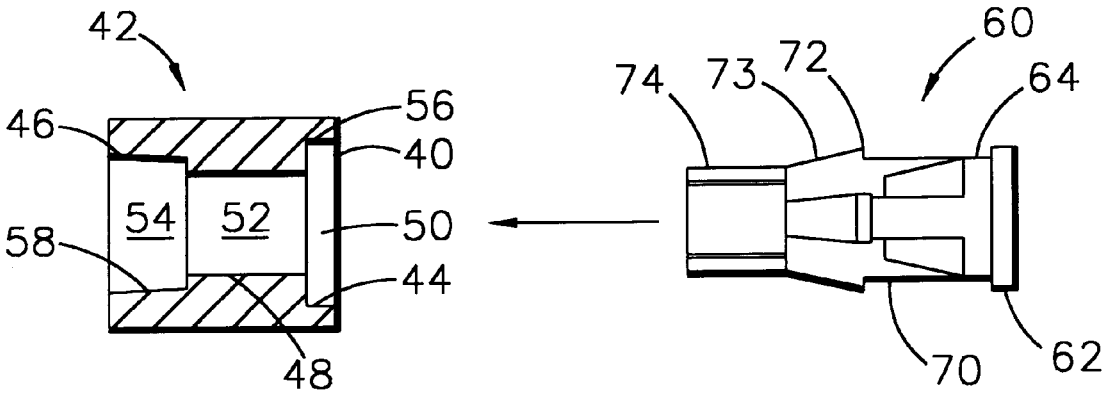
FIG. 2 shows a sleeve ready for insertion into a collar formed in a housing of a radio telephone.

FIG. 2 shows an antenna support sleeve 60 in alignment with an opening 40, formed in the housing of the radio telephone, ready for insertion into the opening 40. The opening 40 is defined by the outer end or mouth 44 of a collar 42 which encircles a generally cylindrical volume. The inner end of the collar 42 is designated 46. The internal wall of the collar includes a collar-shaped protuberance 48 which extends along a midsection of the length of the collar 42. The protuberance 48 divides the volume enclosed by the collar 42 into three regions: an outer region 50 at the outer end of the collar 42; an inner region 54 at the opposite inner end of the collar 42; and an intermediate region 52 between the inner and outer regions 54, 50 located within the volume defined by the collar-shaped protuberance 48. The protuberance 48 effectively provides an inward step in the internal wall of the collar 42. The end of the protuberance 48 adjacent the outer region 50 provides a shoulder 56 and the end adjacent the inner region 54 provides a shoulder 58.

Figure 3:
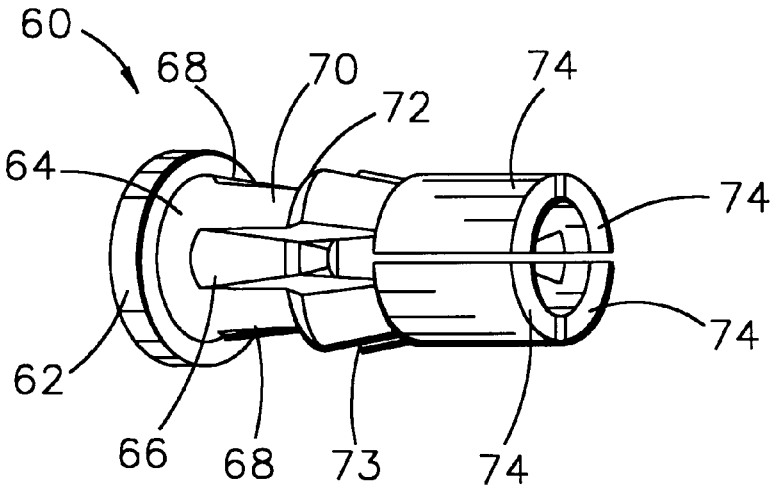
FIG. 3 shows a perspective view of the sleeve in FIG. 2.

The sleeve is also shown in FIG. 3. The sleeve 60 comprises an annular lip 62 from the internal periphery of which upstands a short annular wall 64, and a plurality of fingers which extend from the annular wall 64. There are eight fingers in total, four first fingers 66 and four second fingers 68 which extend alternatively from equispaced and equisized segments of the wall 64. The second fingers 68 extend perpendicularly to the plane of the annular wall 64 and the first fingers 66 converge inwardly at a small angle relative to the second fingers 68. The first fingers together form a first finger jaw 67. The second fingers 68 each comprise a first portion 70 connected to the annular wall 64 which has an outwardly projecting barb 72 formed thereon and a second portion 74. The barb 72 includes a sloped leading face 73 adjacent the second portion 74. The length of the first portion of the second fingers 68 equals the length of the first fingers 66. The second portions 74 of the second fingers 68 each comprises an arcuate wall portion of just less than 90° which extends from the first portion 70 of the second fingers 68 in a plane perpendicular to that annular wall 64 with a radius equal to that of the annular wall 64. Together, the second portion 74 form a split collar with the splits being axially aligned with the central longitudinal axes of the first fingers 66. The second portions 74 include wedge surfaces 76, the apex of which point inwardly of the sleeve. The wedge surface 76 of the second portions 74 together form a second finger jaw 69. It will be noted that, in their natural biased position, the spacing between opposite fingers of the second finger jaw 69 is greater than that of the first finger jaw 67. The first and second finger jaws are best seen in FIG. 11.

Referring back to FIG. 2, in order to push-fit the antenna support sleeve 60 in the opening 40 in the housing, the sleeve 60 is aligned with the mouth 44 of the collar 42 as shown. On pushing the sleeve 60 into the opening 40, the leading faces 73 of the barbs 72 come into contact with the protuberance 48 which causes the second fingers 68 to be urged inwardly. It should be noted that the inward urging of the second finger 68 has no appreciable effect on the converging first fingers 68. Insertion of the sleeve 60 is completed as shown in FIG. 4 when its annular lip 62 abuts against the shoulder 56 of the collar 42, at which point the barbs 72 released form the inward urging of the protuberance 48 are free to spring out into engagement with the shoulder 58 and so lock the sleeve 60 in place in the opening 40.

Because of the cylindrical nature of the collar 42, the rotational orientation of the sleeve 60 is irrelevant during insertion. This is a significant practical advantage during assembly.

In other embodiments (not illustrated), the sleeve 60, when fitted to the opening 40 in the housing, need not be substantially fully inserted therein. To the contrary, the majority of the sleeve may project from the opening 40.

Figures 4, 5:
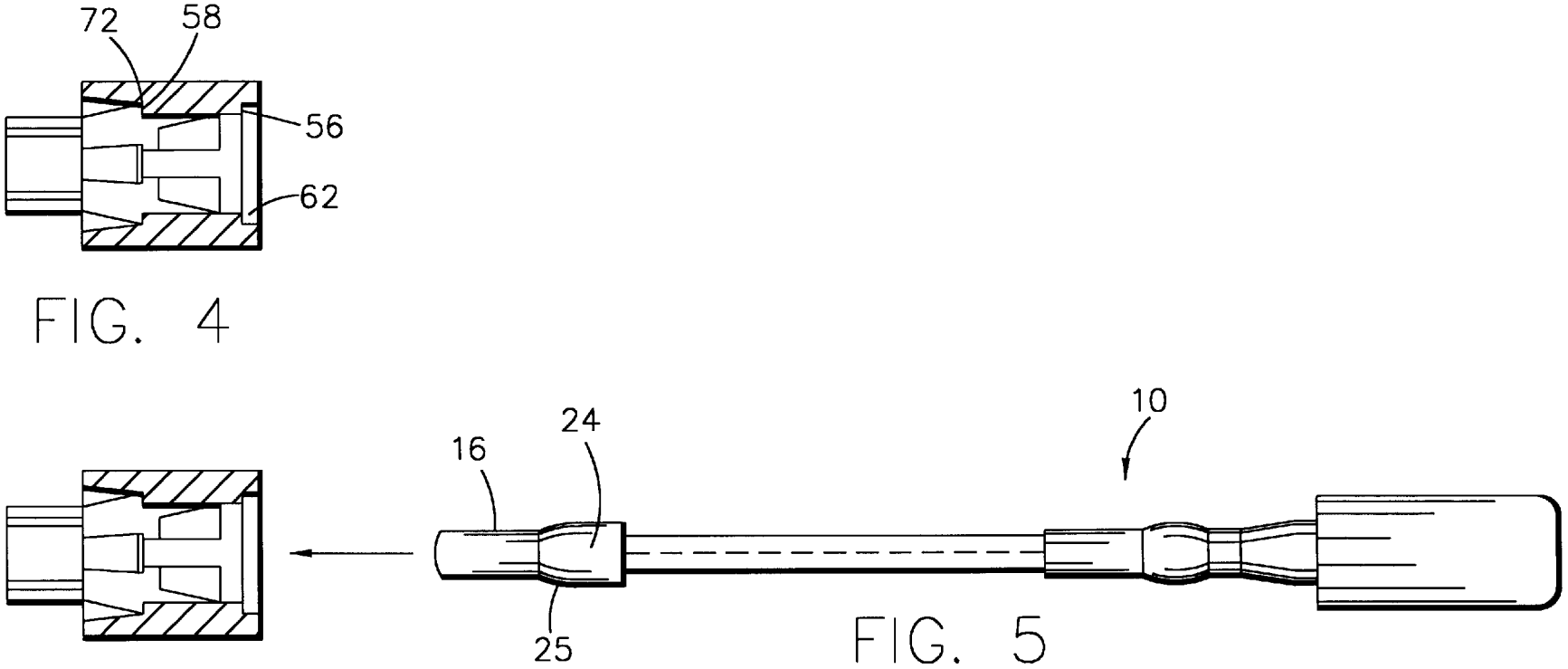
FIG. 4 shows the sleeve inserted into the collar.
FIG. 5 shows the road antenna of FIG. 1 ready for insertion into the sleeve.
Figure 6:
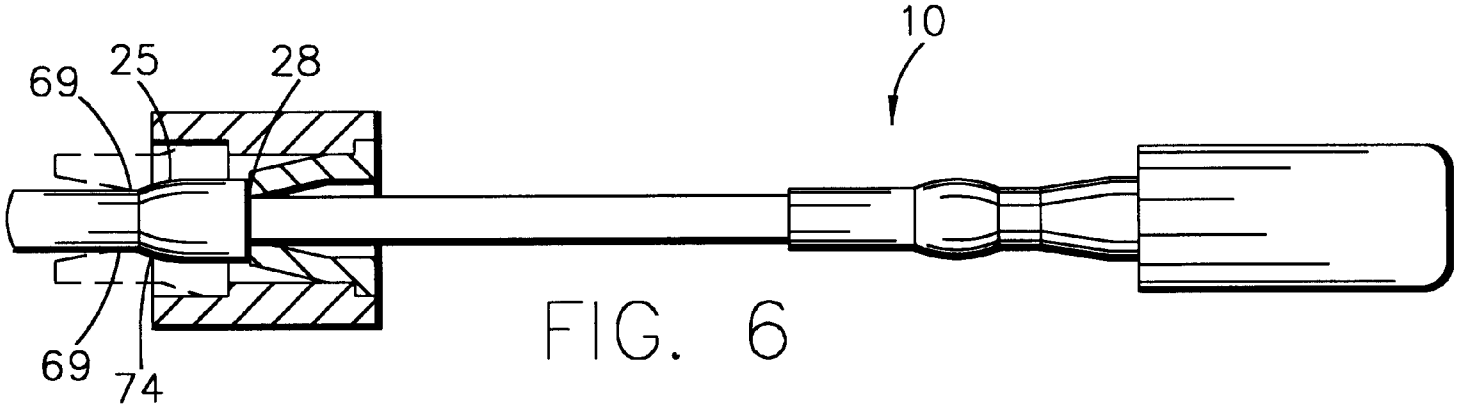
FIG. 6 shows the mounted rod antenna in its fully extended position.

In order to mount the rod antenna 10 in the antenna support sleeve 60, the rod antenna 10 is aligned with the support sleeve 60 as shown in FIG. 5. On pushing the rod antenna 10 into the sleeve 60, the rod antenna 10 moves freely until the first contact element 16 comes into contact with the first finger jaws 67. As the frusto-conical portion 25 and subsequently the cylindrical portion 24 of the first contact element passes through the first finger jaws 67 the first fingers 66 are urged outwardly from their natural bias positions. Once the first contact element 1 6 has completely passed through the first finger jaws 67, the first fingers 66 are free to spring back into their natural bias position as shown in FIG. 6. The rod antenna 10 has thus been fitted to the sleeve 60 as it can then not be removed from the sleeve 60 simply by pulling, because the end surface 28 acts as a stop preventing the first contact element 16 from being withdrawn past the first finger jaws 67.

Figure 7:
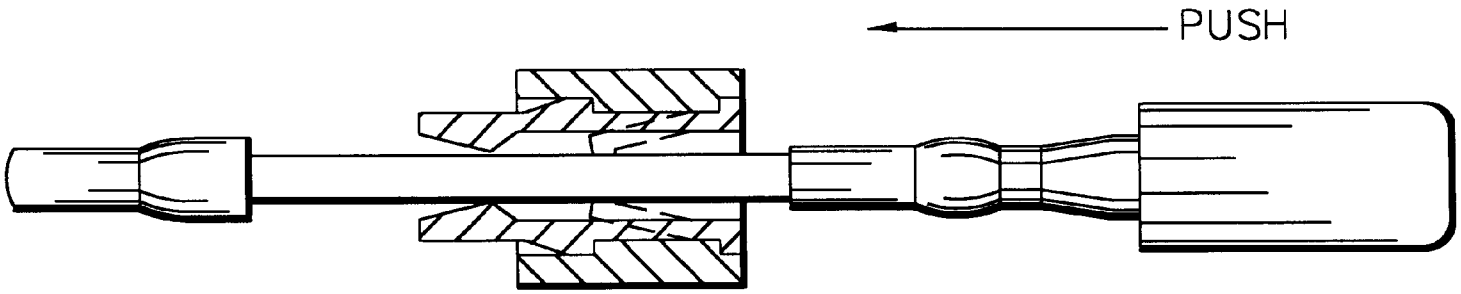
FIG. 7 shows the rod antenna in its partially extended/retracted position.
Figure 8:
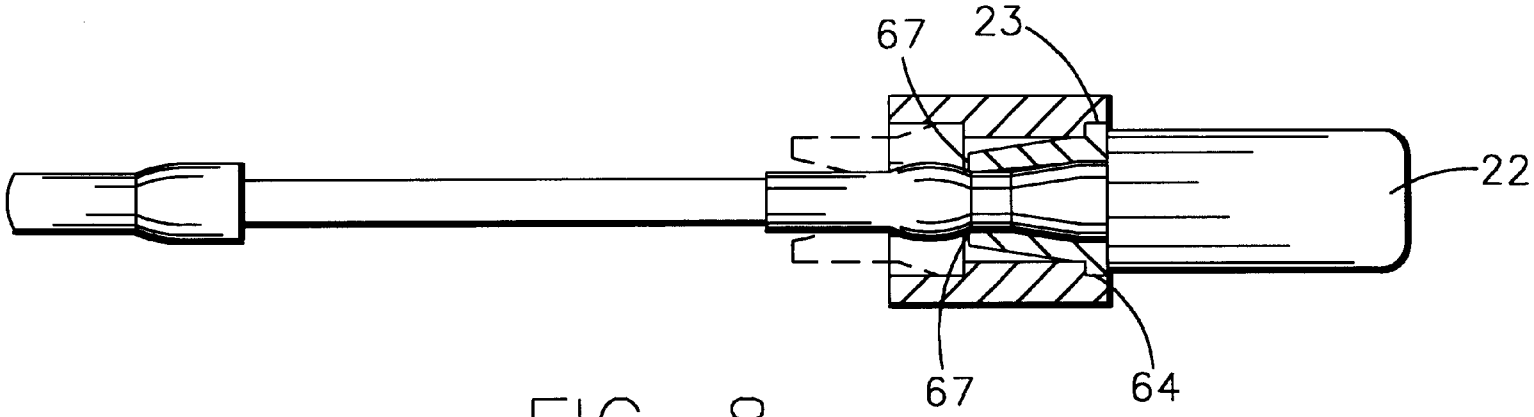
FIG. 8 shows the road antenna in its fully retracted position.

In FIG. 6, the rod antenna 10 is in its fully extended position. The rod antenna 10 is gripped or supported positively in this position by the second finger jaws 69 particularly the wedge portions 74 thereof which engage the frusto-conical portion 25 of the first contact element 16. By pushing the rod antenna 10 so as to cause the frusto-conical portion 25 to bear against the wedge portion 74 and thereby outwardly deflecting the second fingers 68, the rod antenna 10 can be slid further into the housing as shown progressively in FIGS. 7 and 8. In FIG. 8, the rod antenna is in its fully retracted position. Further retraction is blocked by the bottom surface 23 of the insulating cap 22 coming into abutment with the lip 64 of the sleeve 60. It will be noted that during retraction both first and second jaws 67,69 grab the rod antenna 10 and thus provide the sensation of resistance to the user. The fingers of the first and second jaws both present surfaces at an acute angle to the axis of travel of the rod antenna 10. This angling, the flexibility of the fingers 66,68 together with the spacing of the opposed fingers in the respective jaws enables the fingers 66,68 to be deflected by the undulations of the second contact element 18.

In the fully retracted position of FIG. 8, the rod antenna 10 is positively held in place by the first jaws 67 which rest on the end of the bowed portion 32 adjacent the cylindrical portion 34. In order to move at all, the rod antenna 10 must be pulled with sufficient force to deflect the first fingers 66 apart sufficiently to allow the section of the bowed portion 34 of maximum diameter to pass therethrough. This has the two fold effect of inhibiting the rod antenna 10 from rattling when in its fully retracted position and also affording to the user a sensation of positively overcoming a locking force on initially pulling the rod antenna 10.

If the antenna rod 10 is then pulled from the fully retracted positions of FIG. 8 so as to slide it to its fully extended position in FIG. 6, the spacing of the opposed fingers in the respective jaws and their flexibility enables the fingers 66,68 to be deflected to enable the rod antenna 10 to reach this position. However, the perpendicular, face-against-face contact of the stop surface 28 of the first contact element 16 with the tip of the fingers 66 prevents any deflection of the fingers

66. This limits the travel of the rod antenna 10 and thus prevents it from being casually removed from the sleeve 60.

Figure 9:
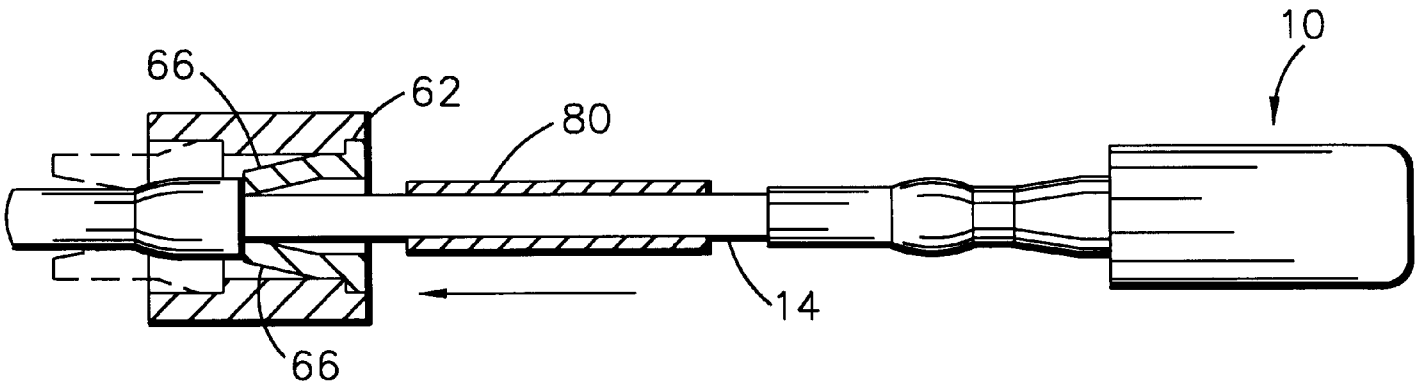

In order to remove the rod antenna 10 from the sleeve 10, a hand-tool is employed as shown in FIG. 9. The hand-tool comprises a semicircular bushing 80. The bushing 80 is used by sliding it down the insulating covering 14 and into the sleeve 60 until it abuts the stop surface 28 of the first contact element 16. When the bushing 80 reaches the contact element 16 it has already deflected the first fingers 66 into a position in which they extend perpendicularly to the plane of the annular lip 62. The housing 80 and the rod antenna 10 can then together be slidingly withdrawn from the sleeve 60. As shown in FIG. 11, the first fingers 66 thereafter resume their converging natural bias position.

The sleeve 60 is plastic. Electrical connection to the radio transmission and reception circuitry (not shown) can be by any suitable means. For example, the wedge surfaces 76 may include a conductive feed to the transmission and reception circuitry.

Figure 12A:
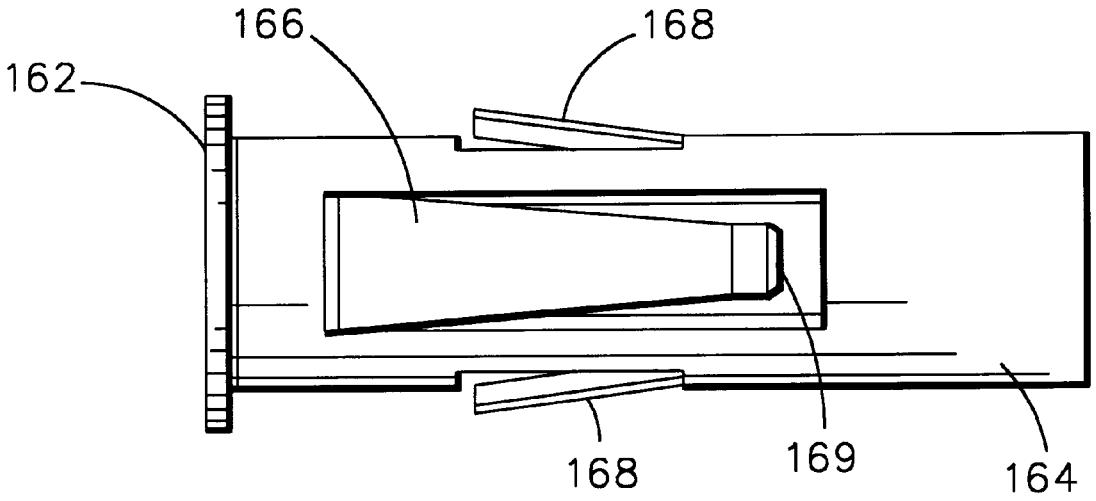
FIGS. 12(*a–c*) show an alternative sleeve design.
Figure 12B:
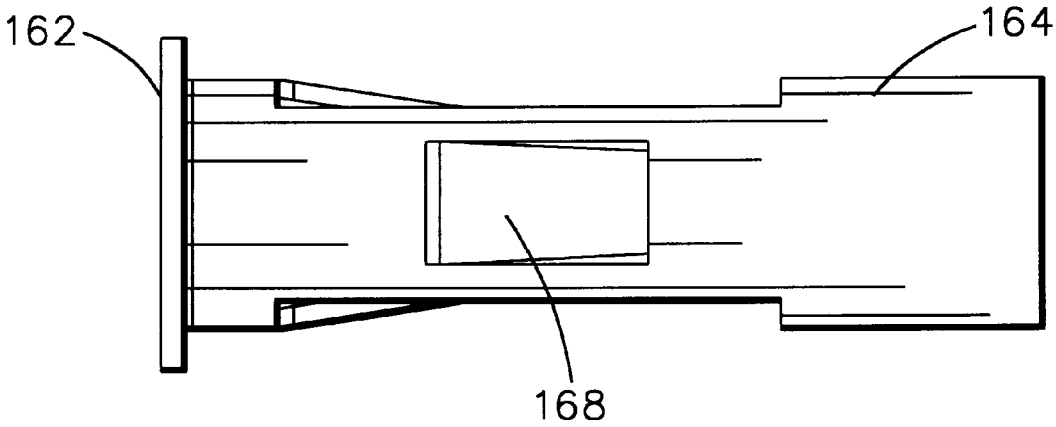
Figure 12C:
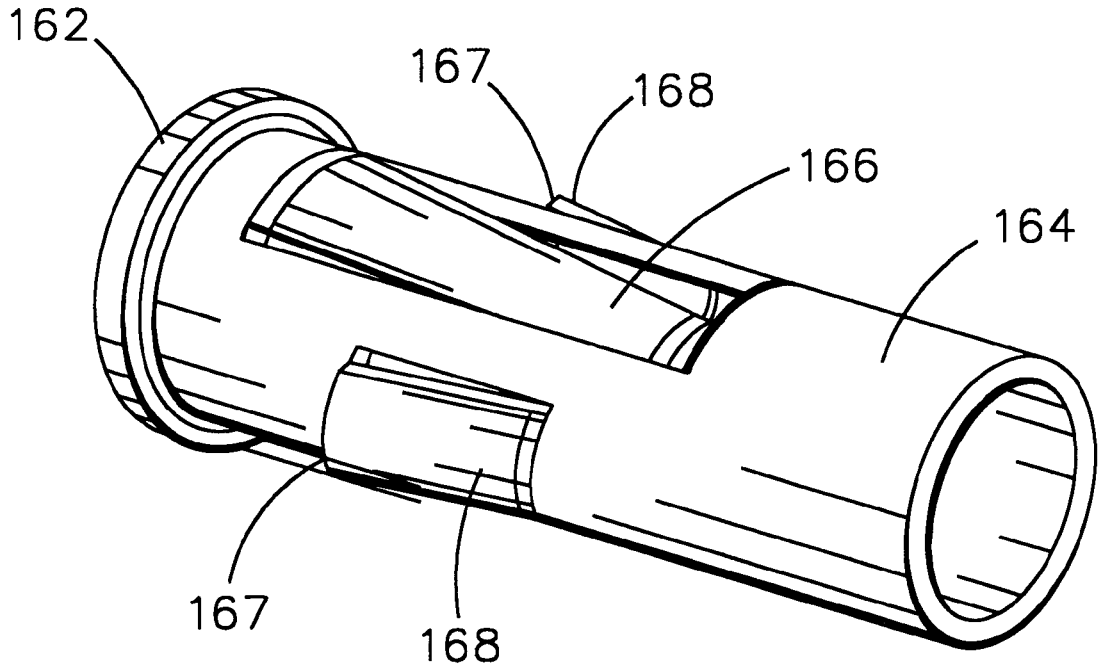

An alternative metallic sleeve 100 is shown in FIGS. 12 (*a–c*). This sleeve comprises an annular lip 162 from which upstands a long annular wall 164. A plurality of fingers are formed in the wall 164. Two inwardly-directed, relatively long first fingers 166 and two outwardly-directed relatively short, second fingers 168 and fingers 166. The fingers 166,168 are shown in their natural bias positions and are resiliently displaceable/deflectable outwardly and inwardly, respectively. This sleeve 100 operates in generally the same way as sleeve 60. The second fingers 68 perform the generally same role as the second fingers 68 with the ends 167 of the fingers 166 engaging the shoulder 58. The first fingers 166 perform the same role as the first fingers 66 and includes a flat end 169 the plane of which is generally parallel to that of the annular lip 162.

What is claimed:

1. An antenna support sleeve for slidably mounting therein a rod antenna comprising means for push-fit mounting the sleeve to a radio housing and a resiliently inwardly-directed first member to block sliding removal of the antenna, the first member being outwardly displaceable to permit sliding removal of the antenna from the sleeve.

2. A sleeve as in claim 1, wherein the first member is outwardly displaceable by a tool inserted from the end of the sleeve from which the rod antenna is to be extended for operation.

3. A sleeve as in claim 1, wherein the push-fit mounting means comprises a second inwardly displaced resilient member adapted to lockingly engage the housing.

4. A sleeve as in claim 3, wherein the first and second members are independently displaceable relative to one another.

5. A radio device comprising a housing having an opening and a retaining surface;

an antenna support sleeve inserted in the opening; and a rod antenna mounted for sliding movement in the antenna support sleeve between extended and retracted positions, the antenna including a stop surface;

the sleeve including:

a first resilient, inwardly-directed member which abuts the stop surface when the antenna is in its fully extended position to block sliding removal of the antenna from the sleeve, the first member being outwardly displaceable using a tool to allow the stop surface to be slid past the first member and thereby enable sliding removal of the antenna from the sleeve and a second resilient member which engages the retaining surface to prevent removal of the sleeve from the housing.

6. A radio device as in claim 5, wherein the first member bears against the rod antenna during sliding.

7. A radio device as in claim 5, wherein the second member bears against the rod antenna during sliding.

8. A radio device as in claim 5 wherein the rod antenna includes a contact element which co-operates with said first member to positively hold the rod antenna in a predetermined position.

* * * * *